US009855585B2

(12) United States Patent
Kokubun

(10) Patent No.: US 9,855,585 B2
(45) Date of Patent: Jan. 2, 2018

(54) PRESSURE SCREEN

(71) Applicant: Voith Patent GmbH, Heidenheim (DE)

(72) Inventor: Kiyoshi Kokubun, Fukushima Ken (JP)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 15/044,658

(22) Filed: Feb. 16, 2016

(65) Prior Publication Data

US 2016/0158804 A1 Jun. 9, 2016

Related U.S. Application Data

(63) Continuation of application No. PCT/EP2014/067209, filed on Aug. 12, 2014.

(30) Foreign Application Priority Data

Aug. 20, 2013 (DE) ..... 10 2013 216 433

(51) Int. Cl.
*B07B 1/00* (2006.01)
*B07B 1/20* (2006.01)
(Continued)

(52) U.S. Cl.
CPC ..... *B07B 1/20* (2013.01); *B07B 1/24* (2013.01); *D21D 5/02* (2013.01); *D21D 5/023* (2013.01);
(Continued)

(58) Field of Classification Search
CPC .... B07B 1/18; B07B 1/20; B07B 1/22; B07B 1/24; D21D 5/02; D21D 5/023; D21D 5/026
(Continued)

(56) References Cited

U.S. PATENT DOCUMENTS 3,713,536 A * 1/1973 Hooper ..... B07B 1/00 209/273
4,268,381 A * 5/1981 Hooper ..... D21D 5/026 209/273
(Continued)

FOREIGN PATENT DOCUMENTS

DE 37 01 669 A1 8/1988
EP 2 602 386 A1 6/2013
(Continued)

OTHER PUBLICATIONS

Notice of Transfer of International Research Report and the Written Notice Issued for International Searching Authority or Statement dated Sep. 30, 2014 for International Application No. PCT/EP2014/067209 (9 pages).

*Primary Examiner* — Joseph C Rodriguez
*Assistant Examiner* — Kalyanavenkateshware Kumar
(74) *Attorney, Agent, or Firm* — Taylor IP, P.C.

(57) ABSTRACT

A pressure screen for cleaning a fibrous stock including a screen element which has a rotationally symmetrical configuration about a screen axis. The screen element divides the pressure screen into an inlet chamber and an accepted stock chamber. The inlet chamber is connected at a first axial end with a suspension inlet and at a second axial end with a reject outlet. The accepted stock chamber is connected with an accepted stock outlet. The pressure screen also includes a rotor situated in the inlet chamber and including a plurality of rotor blades. The rotor rotates about the rotational axis relative to the screen element. The plurality of rotor blades is arranged on a plurality of circumferential planes of the rotor. The width of an annular gap between the rotor and the screen element decreases from the suspension inlet to the reject outlet.

12 Claims, 1 Drawing Sheet

(51) Int. Cl.

| | |
|---|---|
| ***D21D 5/02*** | (2006.01) |
| ***B07B 1/24*** | (2006.01) |
| *B07B 1/22* | (2006.01) |
| *B07B 1/18* | (2006.01) |

(52) U.S. Cl.
CPC ..... *D21D 5/026* (2013.01); *B07B 1/18* (2013.01); *B07B 1/22* (2013.01)

(58) Field of Classification Search
USPC ..... 209/303, 304, 305, 306
See application file for complete search history.

(56) References Cited

U.S. PATENT DOCUMENTS

| | | | | | |
|---|---|---|---|---|---|
| 4,287,055 | A * | 9/1981 | Holz | B01D 35/20 | 209/240 |
| 4,642,189 | A * | 2/1987 | Hooper | D21D 5/026 | 162/55 |
| 4,697,982 | A * | 10/1987 | Hooper | B01D 29/118 | 209/273 |
| 5,476,178 | A * | 12/1995 | Lamort | D21D 5/026 | 209/273 |
| 5,547,083 | A * | 8/1996 | Alajaaski | B01D 29/118 | 162/55 |
| 5,622,267 | A * | 4/1997 | Hautala | D21D 5/026 | 209/273 |

FOREIGN PATENT DOCUMENTS

| | | | |
|---|---|---|---|
| FR | 1 448 814 | A | 8/1966 |
| GB | 2 222 967 | A | 3/1990 |
| WO | 98/53135 | A1 | 11/1998 |

* cited by examiner

PRESSURE SCREEN

CROSS REFERENCE TO RELATED APPLICATIONS

This is a continuation of PCT application No. PCT/EP2014/067209, entitled "PRESSURE SCREEN", filed Aug. 12, 2014, which is incorporated herein by reference.

BACKGROUND OF THE INVENTION

1. Field of the Invention

The present invention relates to a pressure screen for cleaning a fibrous stock, and, more particularly, to a pressure screen having a screen element which is of rotationally symmetrical configuration about a screen axis and divides the pressure screen into an inlet chamber and an accepted stock chamber. The inlet chamber is connected at one axial end with a suspension inlet and at the opposite axial end with a reject outlet; and the accepted stock chamber is connected with an accepted stock outlet, and a rotor with rotor vanes is situated in the inlet chamber. The rotational axis of which rotor corresponds to the screen axis and which rotor rotates relative to the screen element. The rotor vanes are arranged distributed over a plurality of circumferential planes of the rotor which run perpendicular with respect to the rotational axis.

2. Description of the Related Art

Pressure screens are used in the preparation of fibrous stock suspensions, particularly in order to process the fibrous stock suspension in a wet screening process. For this purpose a pressure screen of this type includes a screen element that is provided with a multitude of apertures. The fibers contained in the suspension are intended to pass through the apertures in the form of accepted stock, whereas the undesirable solid components are repelled and are again directed out of the screen in the form of rejects.

It can also conceivably be used to separate different fiber components, in other words the shorter from the longer fibers.

Round apertures or slots are generally used as screening apertures. Generally, pressure screens of the type discussed herein are equipped with screen scrapers that have scraping surfaces moving along the screen. This prevents clogging of the screen apertures.

A screen scraper is known from WO 98/53135 that is equipped with blade elements for cleaning of the screen. These blade elements have a hydrodynamic profile that extends over the entire length of the screen element of a screen basket. Due to the relative movement relative to the surrounding suspension, the blade element exerts a pressure at the front and a suction impulse on the back upon the screen that is to be cleaned. Consequently a portion of the suspension that was rejected on the screen or has already passed the screen as accepted stock is sucked back, thereby keeping clear or clearing the screen apertures.

In contrast thereto, the rotor blades are formed for example by elevations in DE-OS 3701669.

What is needed in the art is a pressure screen to reduce the energy intake and the danger of clogging.

SUMMARY OF THE INVENTION

The present invention provides a pressure screen in that the width of the annular gap between the rotor and the screen element decreases from the suspension inlet to the reject outlet.

The through-flow that increases with the smaller annular gap very effectively counteracts clogging.

Depending on the type of fibrous stock and/or structure of the pressure screen, the width of the annular gap may decrease in steps or else continuously.

Since the fibrous stock suspension is increasingly being rotated by the rotor with increasing distance from the suspension inlet, the radial extension of the rotor blades may decrease from the suspension inlet to the reject outlet, which has a corresponding positive effect on the energy requirement.

The radial extension of the rotor blades can decrease here too in steps or continuously. Whereas the stepped decrease may be easier to manufacture, the continuous decrease can provide a more balanced effect.

For an additional counteraction to clogging, the rotor should at least include one recess between the rotor blades in at least one circumferential plane. Moreover, the rotor may have at least three circumferential planes with rotor blades and/or each circumferential plane may include two rotor blades respectively and/or the rotor blades may have the same shape.

The rotor blades of adjacent circumferential planes can moreover be arranged offset to one another in circumferential direction. This too counteracts clogging.

In order to achieve a cross flow in axial direction over the screen element, the rotational axis can be positioned diagonally or perpendicular to the machine plane.

The rotor can be positioned inside the screen element, the screen element can be cylindrical and the rotor can be in the embodiment of a cylindrical drum.

The suspension inlet can hereby be arranged below the reject outlet.

An advantage of the present invention is that it reduces energy intake and it helps to counteract clogging.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
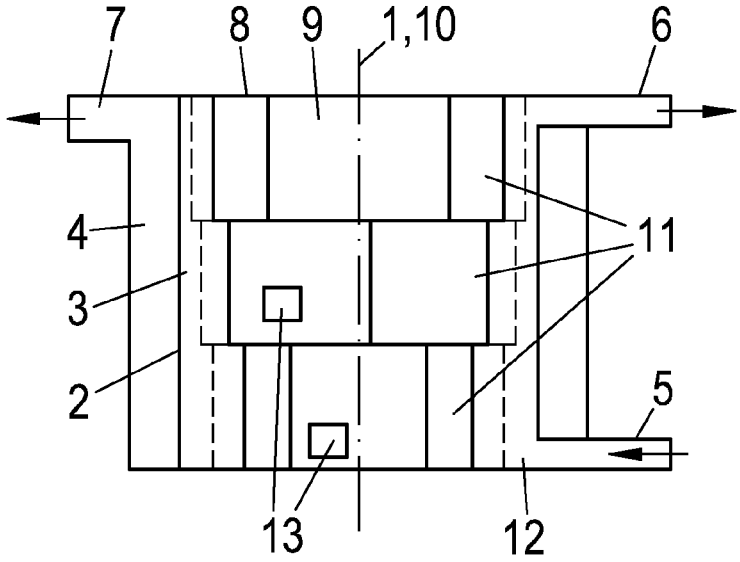
FIG. 1 is a schematic cross-section view of a pressure screen of the present invention, parallel to the rotational axis.
Figure 2:
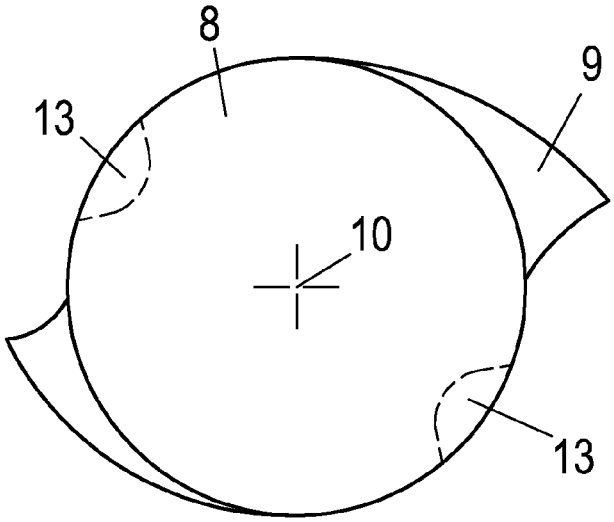
FIG. 2 is a cross-section view of the through rotor as shown in FIG. 1, perpendicular to the rotational axis.

Referring now to the drawings, and more particularly to FIG. 1, there is shown a pressure screen which includes a screen element 2—here in the embodiment of a cylindrical screen basket with vertical screen axis 1—which divides the interior space of the pressure screen into an inlet chamber 3 and an accepted stock chamber 4.

Via a suspension inlet 5 the fibrous stock suspension is fed at the lower end of the screen basket into inlet chamber 3.

With the herein utilized pressure screen the fibrous stock suspension receives an angular momentum that moves it into a circumferential motion. In addition hereto and as a result of the prevailing pressure gradient between lower suspension inlet 5 and reject outlet 6 of inlet chamber 3 that is located at the upper end of the screen basket a transport flow is produced.

Over the path of this transport flow a large portion of the fibrous stock suspension is diverted as intended through screen element 2 as accepted stock into accepted stock chamber 4 and from there is discharged via upper accepted stock outlet 7. During this process a large portion of fibers that are contained in the fibrous stock suspension also pass into accepted stock chamber 4.

The portion of fibrous stock suspension that is rejected by screen element 2 is removed as reject from inlet chamber 3 via reject outlet 6.

In order to avoid that the apertures of screen element 2 become clogged, a screen scraper that moves relative to screen element 2 can be used.

According to the invention this screen scraper can also include a rotor 8 that is rotating in screen element 2 and has rotor blades 9 attached to it. Rotor 8 herein has the shape of a cylindrical drum, whereby rotational axis 10 corresponds to screen axis 1.

All rotor blades 9 herein have the same shape, resulting in a uniform effect on the fibrous stock suspension and screen element 2.

Rotor blades 9 can furthermore be arranged distributed over several—in this case three—circumferential planes 11 of rotor 8 that extend perpendicular to rotational axis 10, whereby each circumferential plane 11 comprises several—in this case two—rotor blades 9.

The width of annular gap 12 between rotor 8 and screen element 2 from suspension inlet 5 to reject outlet 6 can decrease in steps. The stepped transitions can be located between two adjacent circumferential planes 11. Since screen element 2 has a cylindrical shape this means that the diameter of rotor 8 enlarges intermittently from the bottom to the top. This has a very positive effect on the energy requirement of the pressure screen.

In order to further support this, the radial extension of rotor blades 9 also decreases from suspension inlet 5 to reject outlet 6.

The invention may also include other shapes of rotor blades 9. However, manufacture is especially simple, if rotor blade 9 is formed by elevations on rotor 8.

For the same reason, the radial extension of rotor blades 9 can decrease in steps, in other words, the height of the elevations on rotor 8 can decrease in steps from suspension inlet 5 to reject outlet 6, whereby also in this case the steps are positioned between circumferential planes 11.

The cross sectional area of rotor blades 9 extending in rotational direction of rotor 8 is rectangular.

Rotor blades 9 herein not only have the same shape, but also the same dimensions, resulting in a reduction of manufacturing costs. Moreover, rotor blades 9 completely overlap each other in rotational direction in one circumferential plane 11.

In order to reduce clogging danger even further, rotor 8 can include in each circumferential plane 11 at least one recess 13 between rotor blades 9, which can however extend only over a part of the axial extension of respective circumferential plane 11.

Rotor blades 9 of adjacent circumferential planes 11 are moreover arranged offset to one another in the circumferential direction.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pressure screen for cleaning a fibrous stock, comprising:

a screen element which has a rotationally symmetrical configuration about a screen axis, said screen element dividing the pressure screen into an inlet chamber and an accepted stock chamber, said inlet chamber being connected at a first axial end with a suspension inlet and at a second axial end with a reject outlet, said accepted stock chamber being connected with an accepted stock outlet; and a rotor situated in said inlet chamber and including a plurality of rotor blades, said rotor having a rotational axis which corresponds to said screen axis, and said rotor rotating about said rotational axis relative to said screen element, said plurality of rotor blades being arranged on a plurality of circumferential planes of said rotor which run perpendicular with respect to said rotational axis, wherein a width of an annular gap between said rotor and said screen element decreases from said suspension inlet to said reject outlet such that said width of the annular gap decreases in steps, and wherein a radial extension of said plurality of rotor blades decreases from the suspension inlet to the reject outlet.

2. The pressure screen according to claim 1, wherein the radial extension of said plurality of rotor blades decreases in steps.

3. The pressure screen according to claim 1, wherein the radial extension of said plurality of rotor blades decreases continuously.

4. The pressure screen according to claim 1, wherein said rotor includes at least one recess between said plurality of rotor blades in at least one of said plurality of circumferential planes.

5. The pressure screen according to claim 1, wherein said rotor has at least three circumferential planes with said plurality of rotor blades.

6. The pressure screen according to claim 1, wherein each of said plurality circumferential planes includes two rotor blades respectively.

7. The pressure screen according to claim 1, wherein said plurality of rotor blades of adjacent said plurality of circumferential planes are arranged offset to one another in a circumferential direction.

8. The pressure screen according to claim 1, wherein each of said plurality of rotor blades has an identical shape.

9. The pressure screen according to claim 1, wherein the rotational axis is positioned perpendicular to a machine plane.

10. The pressure screen according to claim 1, wherein said rotor is located inside said screen element.

11. The pressure screen according to claim 10, wherein said screen element is cylindrical and said rotor is a cylindrical drum.

12. The pressure screen according to claim 1, wherein said suspension inlet is arranged below said reject outlet.

* * * * *